US005848503A

United States Patent [19]

Toft et al.

[11] Patent Number: 5,848,503

[45] Date of Patent: Dec. 15, 1998

[54] CONSTRUCTIONAL BUILDING SET HAVING AN ELECTRIC CONDUCTOR

[75] Inventors: Allan Toft, Give; Kaj Svejstrup Mikkelsen; Erik Bach, both of Billund, all of Denmark

[73] Assignee: INTERLEGO AG, Baar, Switzerland

[21] Appl. No.: 817,028

[22] PCT Filed: Sep. 28, 1995

[86] PCT No.: PCT/DK95/00391

§ 371 Date: Aug. 4, 1997

§ 102(e) Date: Aug. 4, 1997

[87] PCT Pub. No.: WO96/09867

PCT Pub. Date: Apr. 4, 1996

[30] Foreign Application Priority Data

Sep. 29, 1994 [DK] Denmark ..... 1124/94

[51] Int. Cl.[6] ..... A63H 33/04

[52] U.S. Cl. ..... 52/173.1; 52/220.2; 52/220.3; 446/91; 174/98; 174/117 R

[58] Field of Search ..... 446/91; 174/96, 174/97, 98, 99 R, 99 E, 100, 117 R, 117 F; 52/173.1, 220.2, 220.3

[56] References Cited

U.S. PATENT DOCUMENTS

| | | | |
|---|---|---|---|
| 3,484,984 | 12/1969 | Fischer | 446/91 |
| 4,297,816 | 11/1981 | Kella et al. | 52/220.2 |
| 4,933,513 | 6/1990 | Lee | 174/114 |
| 5,180,890 | 1/1993 | Penergrass et al. | 174/117 F |
| 5,400,554 | 3/1995 | Lo | 52/220.2 |
| 5,486,654 | 1/1996 | Hanak et al. | 174/113 R |

FOREIGN PATENT DOCUMENTS

| | | | |
|---|---|---|---|
| 613497 | 1/1961 | Canada | 174/117 R |
| 150426 | 2/1987 | Denmark . | |
| 155205 | 3/1989 | Denmark . | |
| 1103630 | 11/1955 | France | 174/117 |
| 1266991 | 10/1959 | France | 174/97 |
| 2027553 | 2/1960 | United Kingdom | 174/117 F |
| 9009824 | 9/1990 | WIPO . | |

*Primary Examiner*—Robert Canfield
*Attorney, Agent, or Firm*—Kane, Dalsimer, Sullivan, Kurucz, Levy, Eisele and Richard, LLP

[57] ABSTRACT

A constructional building set has a plurality of building elements (1) with rows of coupling studs (2) arranged in modular measures (M) on one side and complementary coupling means on another side. Also included is an electric conductor (7) having a plurality of mutually insulated wires (4) to establish electric connection between a plurality of electric elements (6) incorporated in the building set. The electric conductor (7) is formed with a transverse dimension which is slighlty greater than the distance (A) between two coupling studs (2). Further, the conductor (7) with the electrically conducting wires (4) is resilient.

7 Claims, 1 Drawing Sheet

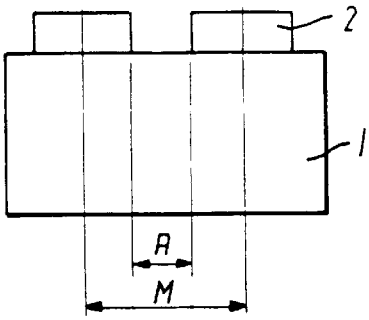
FIG. 1
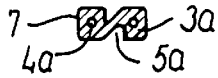
FIG. 2
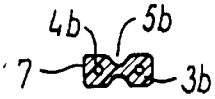
FIG. 3
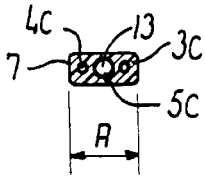
FIG. 4
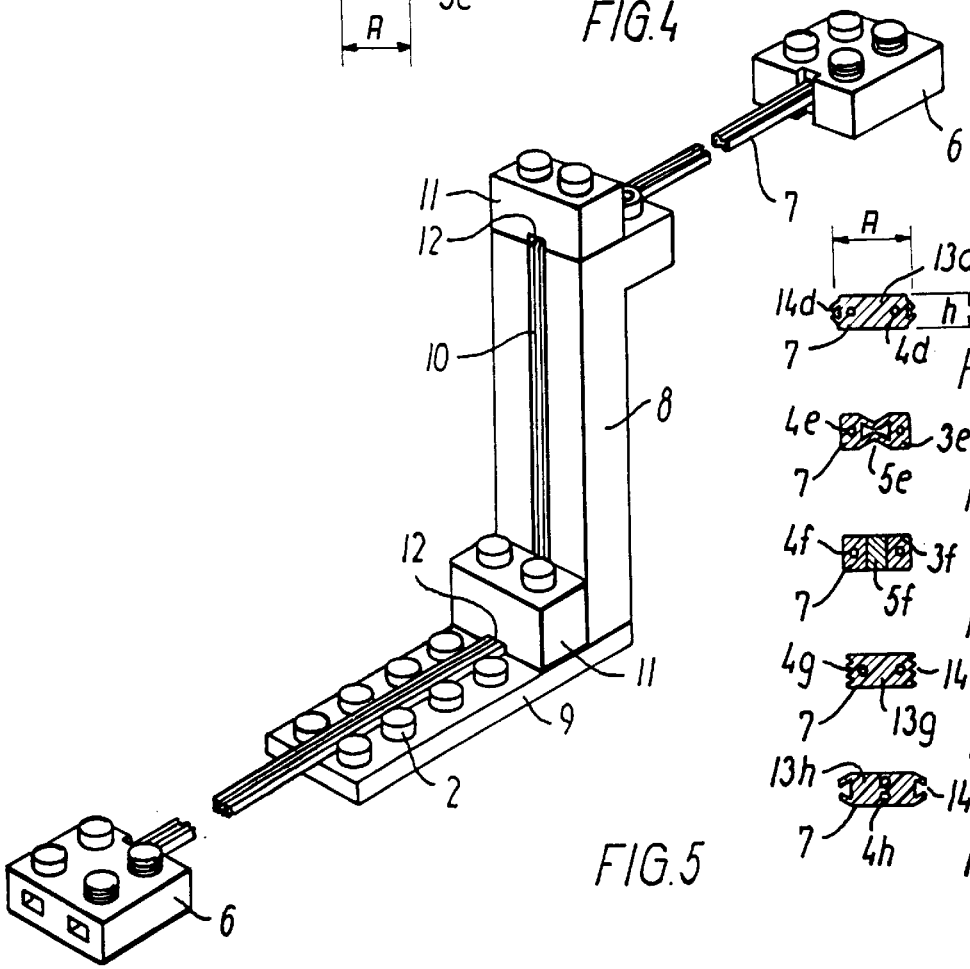
FIG. 5
FIG. 6
FIG. 7
FIG. 8
FIG. 9
FIG. 10

CONSTRUCTIONAL BUILDING SET HAVING AN ELECTRIC CONDUCTOR

The invention concerns a constructional building set of the type defined in the introductory portion of claim 1.

Constructional building sets of this type are well-known, a constructional building set with building elements with rows of coupling studs arranged in modular measures on one side and complementary coupling means on the other side being described in the Danish Patent Specification No. 92 683. The Danish Patent Specification No. 155 205 states how an electric conductor can establish connection between several electric elements incorporated in the building set. The said Danish patent specification discloses a special contact element proof against short-circuit.

The structures disclosed in these patent specifications have been found to be extremely expedient in connection with constructional building sets. However, the electric leads or conductors incorporated in the building set are just fixed to the building set through the use of the contact elements disclosed in the last-mentioned Danish patent specification. The conductors, which are usually relatively rigid, tend to "flap" with respect to the rest of the constructional building set. Functionally, this is rarely a problem, but, on the other hand, there is a wish for removing these flapping leads primarily for aesthetic reasons. In some cases it is also desired to remove the flapping leads for purely technical reasons, since other building elements may get caught by the leads during play and interrupt the electric connection.

WO-A-90/09894 discloses a constructional building set with an electric cable. The cable can be fitted between two rows of coupling studs and has indentations in which the conducting wires of the cable are naked and can make electric contact with conducting coupling studs.

Accordingly, the object of the invention is to provide a constructional building set in which the incorporated electric conductors are secured to a great degree with respect to structures built with the building set.

This object is achieved in that the electric conductors of the constructional building set are constructed with transverse dimensions which are slightly larger than the distance between two coupling studs and the conductor with the electrically conducting wires. The conductor may thus be received between the rows of coupling studs, and its resilient properties ensure that it is secured there by means of friction.

Normally, the conductor is a two-wire lead having an intermediate portion with a longitudinal reduction of its material, which may e.g. be in the form of a centrally extending channel in the longitudinal direction. Alternatively, the reduction may be provided in the form of one or more longitudinal slots or depressions.

Advantageously, the building set may comprise box-shaped elements having vertically extending, open channels in the end walls, since the conductor can thus be received either loosely or frictionally when changing level. Other box-shaped building elements may be formed with recesses in bottom portions of opposed walls, since the building element can then straddle the conductor when coupled to another building element on which the conductor is secured. This type of building elements will preferably be building elements having a width and a length of respectively twice and once the modular measure of the building set, said building element having no internal tube to ensure a three-point coupling as disclosed in the Danish Patent Specification 92 683.

The invention will be explained more fully below in connection with preferred embodiments and with reference to the drawing, in which FIG. 1 is an end view of a building element known per se for use in connection with the constructional building set of the invention;

FIG. 2 is a sectional view of a first embodiment of an electric conductor for use in the constructional building set of the invention;

FIG. 3 is a sectional view of a second embodiment of an electric conductor for use in connection with a constructional building set of the invention;

FIG. 4 is a sectional view of a third embodiment of an electric conductor for use in a constructional building set of the invention;

FIG. 5 is a perspective view of a structure built with a constructional building set of the invention;

FIG. 6 is a sectional view of a fourth embodiment of an electric conductor for use in a constructional building set of the invention;

FIG. 7 is a sectional view of fifth embodiment of an electric conductor for use in a constructional building set of the invention;

FIG. 8 is a sectional view of a sixth embodiment of an electric conductor for use in a constructional building set of the invention;

FIG. 9 is a sectional view of a seventh embodiment of an electric conductor for use in a constructional building set of the invention; and FIG. 10 is a sectional view of an eighth embodiment of an electric conductor for use in a constructional building set of the invention.

FIG. 1 shows a building element 1 having coupling studs 2, and the building element 1 is of the type which is known e.g. from the Danish Patent Specification No. 92 683. The building element 1 has coupling means known per se in the bottom for cooperation with the coupling studs 2 on another building element (not shown). The building element 1 has a modular measure M, which may e.g. be defined at a distance between the centres of two coupling studs 2. In the shown embodiment, the building element 1 has a width precisely corresponding to twice the modular measure M. The building element 1 may e.g. have a length corresponding to four times the modular measure M and thus have two rows of four coupling studs 2 each. The distance between two sides of the coupling studs that face each other is indicated by the distance A.

FIG. 2 shows a first embodiment of an electric conductor according to the invention, it being seen that the conductor is a two-wire conductor. The wires 4*a* of the conductor are embedded in longitudinal plastics members 3*a*, and it will be seen that the conductor has an intermediate portion 5*a*. The conductor is generally designated by the reference numeral 7 and is made by extrusion of a suitable plastics material. In the embodiment shown in FIG. 2, the conductor 7 has a width which is slightly greater than the distance A between the coupling studs 2 on the element shown in FIG. 1. Further, the conductor is formed with a flexible or resilient intermediate portion 5*a*, so that the conductor 7 may be squeezed together in the transverse direction. When the conductor 7 is mounted between the coupling studs 2 on the building element shown in FIG. 1, the conductor will be compressed in the transverse direction, and the conductor will be secured by friction against the sides of the coupling studs. When the width of the conductor is made just slightly larger than the distance A, it is ensured that the conductor is easy to secure between the coupling studs and is also easy to release again therefrom.

In FIG. 2, the conductor is formed with an intermediate portion 5*a*, which is in the form of an inclined wall that connects the insulation members 3*a* of the conductor.

In the embodiment shown in FIG. 3, the conductor 7 has an intermediate portion 5*b* that connects the insulation members 3*b*, which contain respective wires 4*b*. The intermediate portion 5*b* here has longitudinal depressions to impart flexibility. In this situation, too, the intermediate portion is resilient and can be received between rows of coupling studs 2 of a building element.

In the embodiment shown in FIG. 4, the conductor is formed with a centrally arranged through channel 13 in the intermediate portion 5*c*. The conductor 7 will thus appear as a lead having a substantially rectangular cross-section. The conducting wires 4*c* will still be embedded in a member 3*c* of an insulating material. It also applies here that the width of the conductor 7 is just slightly greater than the distance A between two faces on the coupling studs that face each other.

The expression "that the conductor has a width which is just slightly greater than the distance A" means that the width is so large that a frictional force is exerted between the conductor 7 and the coupling studs 2 when the former is used between these, but is nevertheless not greater than the conductor can readily be placed between the coupling studs without using tools, in consideration of the fact that it is usually children who will use the constructional building set. Depending upon the resilient properties of the insulation material, the width of the conductor 7 will therefore be of the same order as the distance A, and typically less than 10% greater.

The conductor 7 is shown in FIG. 5, where it is terminated with contact elements 6 known per se at the ends. These contact elements 6 are formed with coupling studs 2 which, in addition to serving mechanical coupling purposes, also ensure an electric connection. This is well-known. As appears from the drawing, the contact elements 6 are formed with recesses at the ends, said recesses ensuring that the conductor 7 may pass continuously into corresponding recesses in the building elements 8 and 11, as will be explained later.

A building element 9 is formed with two rows of six coupling studs 2 each, and the conductor 7 is received between these coupling studs 2 in the manner described above. Another building element 11 is built together with the building element 9, it being seen that the building element 11 is formed with recesses 12 on its lower end walls, said recesses having a width corresponding to the distance A and a height corresponding to the thickness of the conductor 7. The building element 11 will thus straddle the conductor 7 when it is connected with the building element 9. A further building element 8 is formed with a vertically extending channel 10, which has such a depth and width as enable the conductor to be fully received therein. Thus, it is not necessary for any frictional coupling to take place between the building element 8 and the conductor 7 in the gap 10. On the contrary, it is frequently an advantage that the conductor is just received loosely in the gap, since the connection at the bottom of the building element 8 with the element 9 is facilitated. Another building element 11 corresponding to the previously mentioned building element is mounted on top of the element 8, and this building element 11 straddlingly secures the conductor 7 by receiving it in the channel formed by the recesses 12.

When the cross-section of a conductor 7 is dimensioned correctly and suitable resilient properties are imparted to the conductor, it can be connected with a constructional building set known per se. Further, it is ensured by providing other building elements 8, 11 with suitable recesses and channels that the conductor can be guided without interference with the construction of desired structures.

The conductor has been explained in the foregoing as having a flexibility originating from its central part; however, it is clear that the flexibility of the conductor can also have other origins. The side faces facing the coupling studs 2 may e.g. be formed with longitudinal grooves, be convex or be concave. Other structures are also possible.

FIG. 6 shows a fourth embodiment of a conductor of the invention, and it will be seen that the conductor has two conducting wires 4*d* which are here embedded in one and the same plastics member 13*d*, in contrast to the embodiments previously mentioned. Thus, the plastics member 13*d* is not separated by a flexible intermediate portion, but, on the contrary, it is provided with obliquely protruding flaps 14*d* on the sides facing the coupling studs in use. It is noted that the width of the portion 13*d* is slightly smaller than the distance between two coupling studs, the flexibility being obtained from the resilient flaps 14*d*. The overall width of the conductor is thus slightly greater than the distance between two coupling studs.

FIG. 7 shows a fifth embodiment, and it will be seen here that the conductive wires 4*e* are contained in respective portions 3*e*. The portions 3*e* are connected through a flexible central portion 5*e*, which consists of two bridge-forming walls with sharp bends in the centre to that the tops of the walls are positioned in the immediate vicinity of each other. This gives the intermediate portion 5*e* a butterfly-shaped through passage.

FIG. 8 shows a sixth embodiment of a conductor of the invention, and it will be seen here that the conducting wires 4*f* are contained in respective portions 3*f* which are separated by an intermediate portion 5*f*. While the portions 3*f* are made of a relatively rigid rubber or plastics material, the intermediate portion 5*f* is made of a foam product which is considerably more soft or resilient. It is thus the intermediate portion 5*f* that gives the conductor its resilient properties in this embodiment.

FIG. 9 shows a seventh alternative embodiment of the conductor of the invention, and this, like the embodiment shown in FIG. 6, consists of two conducting wires 4*g* which are contained in one and the same plastics member 13*g*. The resilient properties of the conductor are imparted by wedge-shaped flaps 14*g* which extend in the longitudinal direction of the conductor. These wedges bend aside when the conductor is placed between two rows of coupling studs of a building element.

FIG. 10 shows an embodiment of the conductor of the invention which widely corresponds to the one shown in FIG. 6, but with the conducting wires 4*h* placed on edge here in the plastics member 13*h*. Here, too, two obliquely protruding flaps 14*h* are provided in each side of the conductor.

It is noted that the protruding flaps 14*d* and 14*h* in the embodiments shown in FIGS. 6 and 10 serve as barbs on the sides of the conductor, and, of course, also these barbs are resilient. The embodiments shown in FIGS. 6 and 10 are of special interest in those cases where the coupling studs have a height which is lower than the thickness of the conductor. It is intended here that the conductor is to be easy to squeeze down between the coupling studs, and that the flaps engaged with the coupling studs serve as barbs so that the conductor has to be subjected to a considerable pull before it is released from the coupling stud. This is particularly expedient precisely in those cases where the thickness h of the conductor is greater than the height of the coupling studs.

Attention is here called to FIG. 7 as well, since in this embodiment—in contrast to the other embodiments which expand perpendicularly with respect to the direction of squeezing—the resiliency instead moves toward the centre of the element upon squeezing. This is particularly advantageous if, as shown in FIG. 5, it is desired to place an element 11 on top of the lead.

We claim:

1. A constructional building set comprising in combination a plurality of building elements (1) having coupling studs (2) arranged in modular measures (M) in at least two parallel rows on one side and complementary coupling means on another side, and an electric cable (7) comprising a plurality of mutually insulated conducting wires (4) to establish electric connection between electric elements (6), wherein the wires are longitudinally embedded in plastic, the cable being resilient in its transverse direction and having a cross-section which is substantially constant over its length, and having a transverse dimension which is slightly greater than the distance between two neighbouring coupling studs (2).

2. A constructional building set according to claim 1, further comprising that the cable (7) is a two-wire conductor having an intermediate portion (5) with a longitudinal reduction of its material.

3. A constructional building set according to claim 2, wherein the reduction **(5*c*) in the material of the cable (7) is provided in the form of a centrally extending channel (13)** in a longitudinal direction.

4. A constructional building set according to claim 2, wherein the reduction **(5*a*, 5*b*) in the material of the cable (7)** is provided in the form of one or more longitudinal slots.

5. A constructional building set according to any one of claims 1–4 further having box-shaped building elements (8) with coupling studs or complementary coupling means, wherein the end walls of the box-shaped building elements (8) are formed with vertically extending, open channels (10) to receive said cable (7).

6. A constructional building set according to any one of claims 1–4 further having box-shaped building elements (11) with complementary coupling means, wherein said boxed shaped building elements are formed with recesses (12) in bottom portions of two opposed walls, and that the recesses (12) have a width corresponding to the distance (A) between two coupling studs and a height corresponding to the thickness of the cable (7).

7. A constructional building set according to claim 6, wherein the box-shaped building elements (12) have a width and a length corresponding to respectively once and twice the modular measure (M) of the building set.

* * * * *